US006000078A

United States Patent [19]

Stefano

[11] Patent Number: 6,000,078

[45] **Date of Patent: *Dec. 14, 1999**

[54] DISPOSABLE BEDPAN SYSTEM FOR USE WITH ELEVATED PATIENT SUPPORT

[76] Inventor: Sandra Stefano, 25600 Columbus Rd., Bedford Heights, Ohio 44146

[ * ] Notice: This patent issued on a continued prosecution application filed under 37 CFR 1.53(d), and is subject to the twenty year patent term provisions of 35 U.S.C. 154(a)(2).

[21] Appl. No.: 08/933,720

[22] Filed: Sep. 19, 1997

Related U.S. Application Data

[60] Provisional application No. 60/026,497, Sep. 19, 1996.

[51] Int. Cl.[6] ..... A61G 9/00

[52] U.S. Cl. ..... 5/695; 5/604; 4/451

[58] Field of Search ..... 5/604, 695; 4/450, 4/451, 452, 457

[56] References Cited

U.S. PATENT DOCUMENTS

| | | | |
|---|---|---|---|
| 3,849,811 | 11/1974 | Cyll | 5/604 |
| 3,921,234 | 11/1975 | Mracek et al. | 4/451 |
| 4,011,610 | 3/1977 | Parker, III et al. | 5/604 |
| 4,847,932 | 7/1989 | Baribault, Jr. | 4/452 |
| 5,001,790 | 3/1991 | Kuhn | 5/695 |
| 5,081,721 | 1/1992 | Stefano | 5/695 |

*Primary Examiner*—Michael F. Trettel
*Attorney, Agent, or Firm*—Donald A. Bergquist

[57] ABSTRACT

A disposable bedpan system for use with a patient underlayment that has a cavity in registry with the buttocks of a supine patient lying thereon is provided wherein the disposable bedpan is supported in said cavity by a laterally-collapsible hoop-like support. In the best mode, the hoop-like support has fulcrum extensions to provide support therefor from a horizontal support upon which said underlayment rest and markings on the disposable bedpan provide a tool to measure the volume of waste from the patient. A padded plug that fills the space between the hoop-like support and the top of the underlayment provides comfort for the patient while the bedpan is installed but not in use.

6 Claims, 3 Drawing Sheets

DISPOSABLE BEDPAN SYSTEM FOR USE WITH ELEVATED PATIENT SUPPORT

This Appln claims the benefit of U.S. Provisional No. 60/026,497, filed Sep. 19, 1996.

INTRODUCTION

This invention relates to disposable bedpans for use with an elevated patient support used principally by people who are confined to bed for medical or other reasons. More particularly, the bedpan system of this invention is designed for use with a patient underlayment device similar to that of previous U.S. Pat. No. 4,949,409, PNEUMATIC PATIENT LIFT TO AID BEDPAN USE and the method of previous U.S. Pat. No. 5,081,721, METHOD OF USING INFLATABLE PATIENT SUPPORT WITH A BEDPAN, both issued to a co-inventor hereof, Sandra Stefano. The bedpan of the present invention, however is not related to the bedpan of common commercial use described in those prior two patents.

As in the previously-mentioned issued patents, an underlayment is provided for placing beneath a bedridden patient to elevate the patient above any underlying mattress or other substantially horizontal support and, by means of a cavity in the underlayment, clearance is provided for the placement of a bedpan for use by the patient. The placement and removal of the bedpan requires no movement of the patient.

In contrast to the previously-mentioned issued patents, however, the underlayment of the present invention need not be inflatable and the cavity therein is not restricted to one that "in plan view substantially matches the shape of said bedpan (of common commercial use) in plan view," as is recited in the previous patents. In the present invention, the bedpan assumes the shape (in plan view) of the cavity in the underlayment.

Anyone who has been confined to bed and has faced using a bedpan for defecation while so confined, appreciates the embarrassment and discomfort associated with the use of a bedpan while bedridden. The discomfort is especially critical for patients whose condition requires them to remain nearly horizontal, not allowing the patient to be raised to approach a sitting position. In such situations, the elevation of the hips caused by the inserted bedpan puts the patient into a position in which most find defecation nearly impossible. Little need be said of the personal discomfort that arises from sustained periods during which defecation is denied, not to mention the physiologic difficulties that may result, such as diverticulitis or impaction.

BACKGROUND

This invention is related to inventions disclosed in prior patents, issued to a co-inventor hereof Sandra Stefano, as U.S. Pat. Nos. 4,949,409 and 5,081,721, both of which issued patents are incorporated herein by reference.

It is known from these patents to provide an inflatable mattress having a through passage therein in registry with the buttocks of a supine patient lying thereupon wherein the through passage provides a cavity to accommodate a bedpan of common commercial use so that, owing to the low inflation pressure of the inflatable mattress, the surface of the mattress may easily be depressed, thereby to permit such bedpan of common commercial use to be inserted into—and subsequently removed from—the cavity.

It is also known to provide disposable bedpans that are used in conjunction with other patient lift devices that are far more rigid than are those described in my aforementioned previous patents. These disposable bedpans that are known comprise bags formed of flexible plastic sheeting and these bags may have a reinforced edge surrounding the opening thereof. In some cases, the edge may be attached to a more rigid rim that is not unlike a toilet seat, which rim maintains the opening in an open configuration to receive wastes while the rim may also serve to hold the bag in position for use by engaging the patient lift device. These known disposable bedpans are not suitable for use with the patient lift devices described in my aforementioned previous patents, nor are they seen as suitable for use in with a standard mattress, whether of foam, upholstered, or innerspring varieties, that are relatively simply adapted with a bedpan hole or bedpan depression therein.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fullly disclosed hereinafter.

SUMMARY OF THE INVENTION

It is an object of this invention to provide a disposable bedpan that is useful with patient underlayment devices having a cavity for receiving a bedpan and having a portion of the surface thereof that is sufficiently soft to permit the depressing of the surface to permit the insertion of—and subsequent removal of—the new disposable bedpan without requiring movement of the patient.

It is an object of this invention to provide a disposable bedpan fabricated from plastic film and adapted to be both received by and supported in use by a flexible hoop-like carrier.

It is an object of this invention to provide such a disposable bedpan and said hoop-like carrier working cooperatively wherein the carrier may be laterally compressed to a very narrow shape for inserting it, along with the associated bedpan, into an underlayment cavity while depressing the underlayment surface the carrier then expanding to engage the periphery of the cavity when it contacts the far wall of the cavity as it is further and ultimately fully inserted, thereby to support the opening of the bedpan in an open condition below the top surface of the underlayment.

It is an object of this invention to provide a bedpan as described above in combination with an underlayment that may be inflatable or may be fabricated of soft materials such as an elastomeric foam or rubber foam.

It is an object of this invention to provide a disposable bedpan that is usefully with patient underlayment devices having a cavity for receiving a bedpan wherein the new disposable bedpan is compressible, thereby to permit the insertion of—and subsequent removal of—the new disposable bedpan without requiring movement of the patient.

It is an object of this invention to provide a disposable bedpan fabricated from plastic film and adapted to be both received by and supported by a flexible hoop-like carrier.

It is an object of this invention to provide such a disposable bedpan and said hoop-like carrier working cooperatively wherein the carrier may be laterally compressed to a very narrow shape for inserting it, along with the bedpan, into—and subsequent removing it from—an underlayment cavity and may be expanded to engage the periphery of the cavity as it is fully inserted, thereby to support the opening of the bedpan in an open condition near the top surface of the underlayment.

It is an object of this invention to provide a bedpan as described above in combination with an underlayment that is neither inflatable nor fabricated of particularly soft materials such as an elastomeric foam or rubber foam that would be easily depressed. Such underlayment could be a mattress of foam, upholstered, or innerspring varieties, that are relatively simply adapted with a bedpan hole or bedpan depression therein.

It is a further object of this invention to provide a support plug for placement atop the rim of the bedpan when it is installed and not in use, such that said support plug fills the upper portion of the cavity that receives said bedpan to produce a substantially smooth surface coextensive with the top surface of the underlayment, and which support plug is adapted for easy removal when use of the bedpan is required.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

This invention might best be described as a bedpan system specially adapted for use by bedridden patients, especially those patients that cannot be moved from a supine position, which bedpan system employs a disposable bedpan. The system comprises the following elements:

a. an underlayment comprising a mattress that may be of conventional construction, but is preferably of foam rubber and more preferably of inflatable construction, said mattress having a cavity contiguous with the top surface thereof and which may be a depression or a through passage deposed substantially in registry with the buttocks of a supine patient lying on the underlayment.

b. a bag-like flexible bedpan, preferably formed of either plastic sheet stock or, alternatively, a waterproof paper-like material (such as TYVEK® non-woven sheeting—TYVEK is a registered trademark of E. I. du Pont De Nemours & Co.) and having an opening. In the best mode, this flexible bedpan is shaped to include a well for measuring the volume of excrement discharged by the patient. The excrement is safe from spilling and is not touched by the nurse or other attendant.

c. a support ring that surrounds and removably engages the opening of said flexible bedpan, thereby to hold the bedpan open while installed in the cavity of the underlayment and to support the opening of the bedpan near the top surface of the underlayment. This support ring of the simplest embodiment comprises a hoop formed of a substantially flat strip of a substantially rigid material. The hoop may be laterally compressed to a narrow shape that may easily be inserted between the legs of a supine patient. Extending from the lower edge of this support ring are two fulcrum extensions, one on each lateral side of the hoop, that are fixedly attached to the support ring or, in the preferred embodiment shown, are an integral part of the original flat strip from which the ring is formed. These fulcrum extensions substantially engage a surface upon which the underlayment rests, thereby to become a fulcrum for tilting the support ring from its inclined insertion position to a stable substantially horizontal installed position. Once the support ring carrying the flexible bedpan is installed, the fulcrum extensions act as vertical supports to maintain the support ring at the proper height.

d. an optional support plug for placement atop the support ring and the associated flexible bedpan when they are installed and not in use, supported by the support ring such that said support plug fills the upper portion of the cavity that receives said bedpan, thereby to produce a substantially smooth surface that is coextensive with the top surface of the underlayment, and which support plug is adapted for easy removal when use of the bedpan is required.

Figure 1:
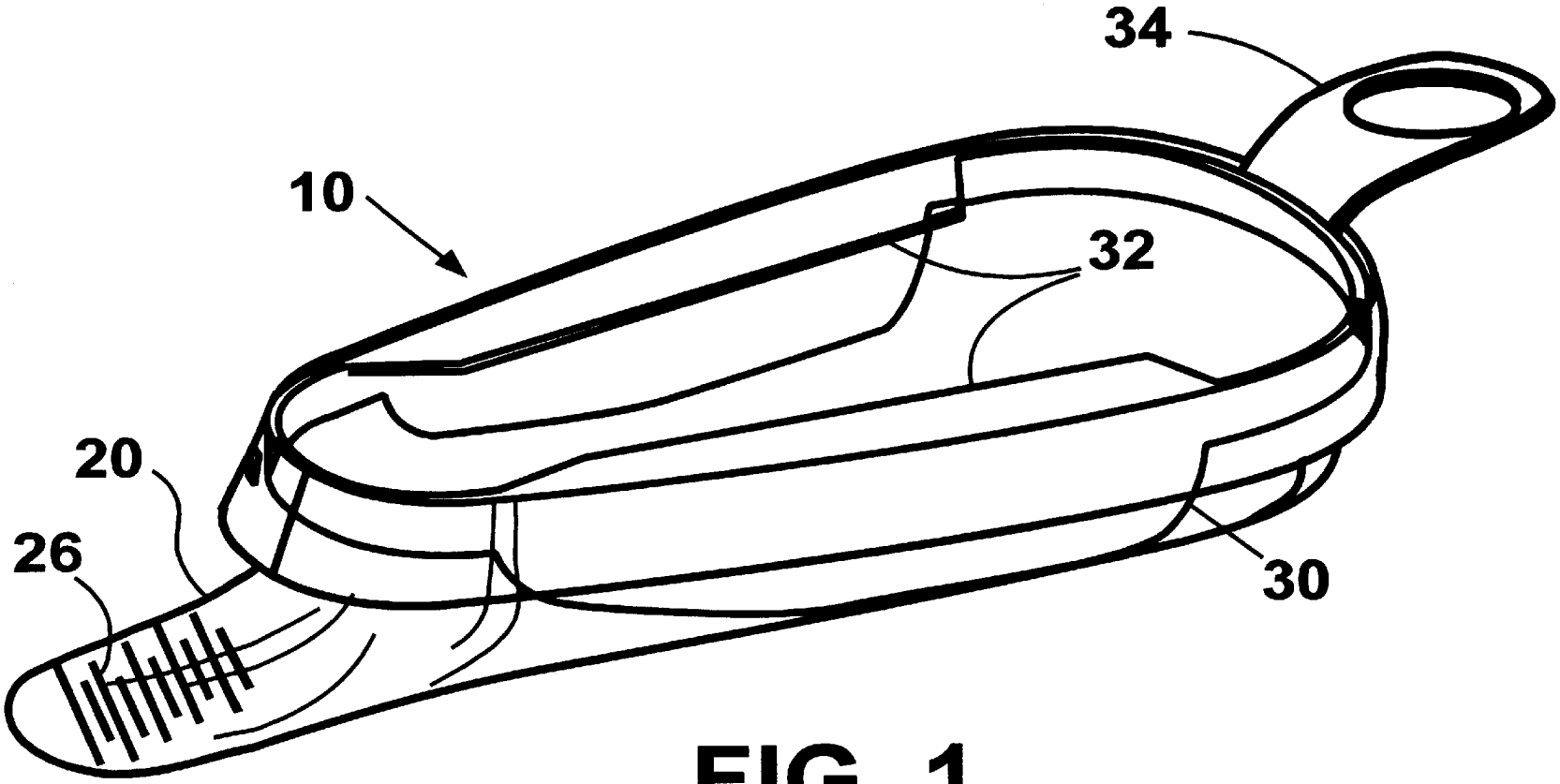
FIG. 1 is a perspective view of a preferred embodiment of the disposable portion of the bedpan system mounted on the reusable portion of the bedpan system and ready for inserting into a mattress cavity.

FIG. 1 shows a preferred embodiment of a bedpan 10 made up of a disposable portion 20 and a reusable portion 30 that are cooperatively and removably engaged before use as taught in this disclosure. The separate elements and their relationship are discussed below. In the preferred embodiment shown in FIG. 1, the reusable ring portion 30, which provides support for the disposable bag portion 20 provides a balancing ledge 32 on each opposing transverse sides thereof to provide auxiliary patient support while the bedpan is in use.

Figure 2:
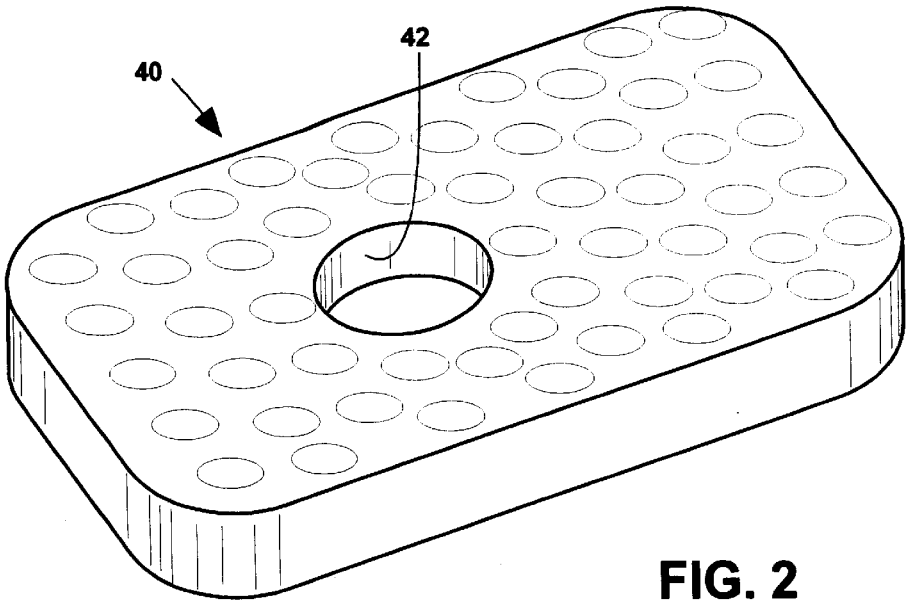
FIG. 2 shows a mattress having a cavity and being of the type with which the present invention is used.

FIG. 2 shows an underlayment 40 of the type useful as a part of the system of this invention. It can be seen that the underlayment 40 appears much like a mattress except that it has a cavity 42 in a position that would be in registry with the buttocks of a human patient supine on the underlayment. In practice, for patients in need of the system of this invention, this underlayment is placed atop a standard mattress, thereby to elevate the patient above the surface of said mattress, thus to provide space between the buttocks of the supine patient and the underlying mattress for placement of the bedpan of this invention. It is also conceivable that the mattress can be done away with, in which case the underlayment 40 would rest substantially upon the bedsprings or other substantially horizontal surface.

Figure 3:
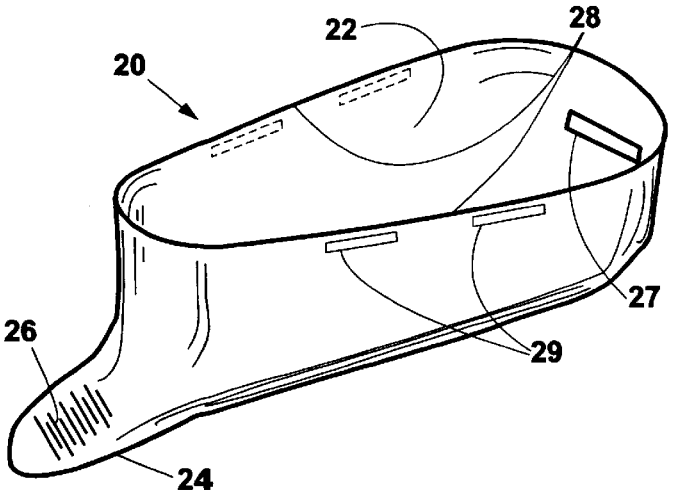
FIG. 3 is a perspective view of a preferred embodiment of the reusable portion of the bedpan system of the present invention.

FIG. 3 shows a disposable bag-like flexible bedpan 20, formed of plastic sheet stock and having an opening 22. In the best mode, this flexible bedpan is shaped to include a well 24 with volume indicators 26 for measuring the volume of excrement discharged by the patient. In practice, the material around the opening 22 is folded back upon itself to form a cuff into which a surrounding support ring, shown in FIG. 4, may be inserted. It is anticipated that the presence of this simple cuff is sufficient to attach the opening of the flexible bedpan 20 to the support ring 30, but it is also possible that the outer surface 28 of the opening 22 of the flexible bedpan may have an adhesive 29 applied thereto by which the opening may be more securely attached to the support ring. Where an adhesive is suggested here, one might use an attachment means such as a button, a snap, a hook-and-loop connecting device (e.g., VELCRO®, hook-and-loop fastener a product of Velcro USA Inc.).

Figure 4:
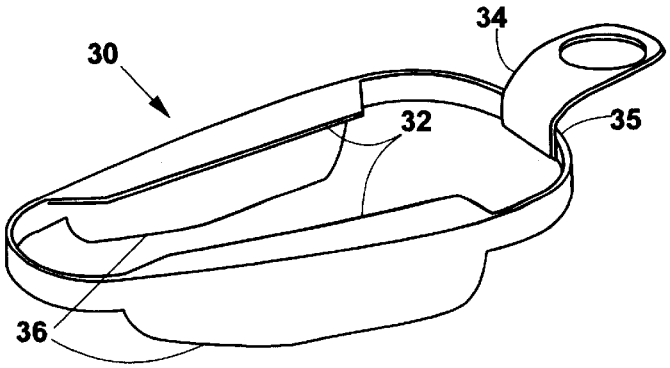
FIG. 4 is a perspective view of a preferred embodiment of the disposable portion of the bedpan system of the present invention.

The support ring 30 of FIG. 4 is formed by bending a band of flat, substantially rigid material into a hoop shape and fastening the ends together. This fastening is intended to be permanent. In practice, for shipping and storage reasons, the fastening may be one that can be suitably engaged in the field, just before use of the support ring. A tab 34 is firmly attached to the support ring at its frontmost point 35, thereby to provide for gripping to pull the ring and the associated flexible bedpan from the cavity. In the most preferred embodiment, balancing ledge is present on each opposing transverse side of the open support ring.

Figure 5:
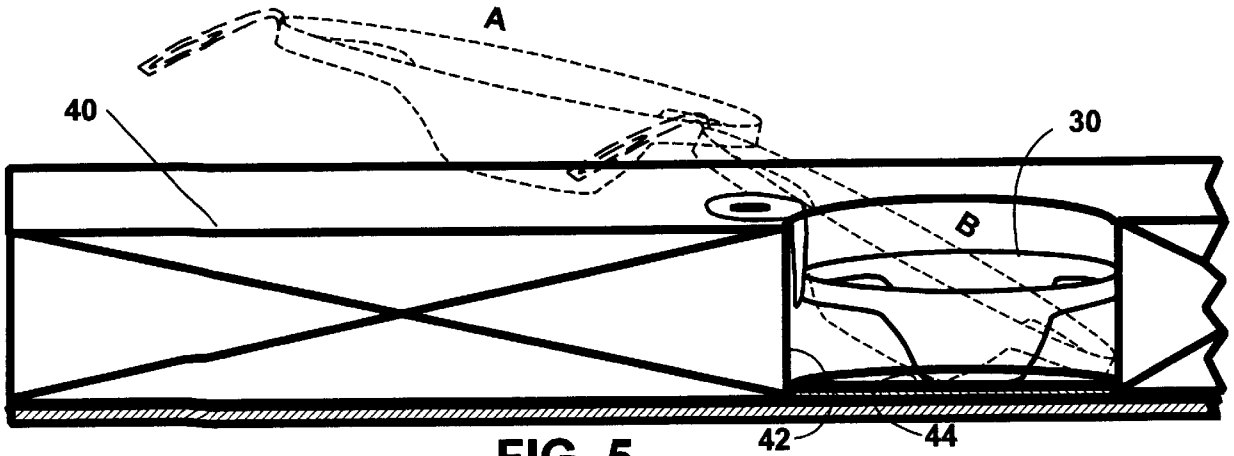
FIG. 5 is a partial cross-section of a mattress of FIG. 1 to show the inserting of a bedpan of the present invention, shown in its simplest embodiment, into the cavity of the mattress.

An important feature of the support ring is the fulcrum extensions 36. The usefulness of the fulcrum extensions is illustrated in FIG. 5. These extensions allow the support ring 30 and the associated flexible bedpan 20 to be inserted into the cavity 42 at an angle as at A and B and then to tip to a substantially horizontal installed position, being supported there by the fulcrum extensions 36. In a preferred mode of this invention, the bottom of the cavity 42 is to be lined with a disk 44 of substantially rigid material to serve as a base for the fulcrum extensions 36, thereby to eliminate wear on any mattress or even a sheet that might be present at the bottom at the cavity.

Figure 6:
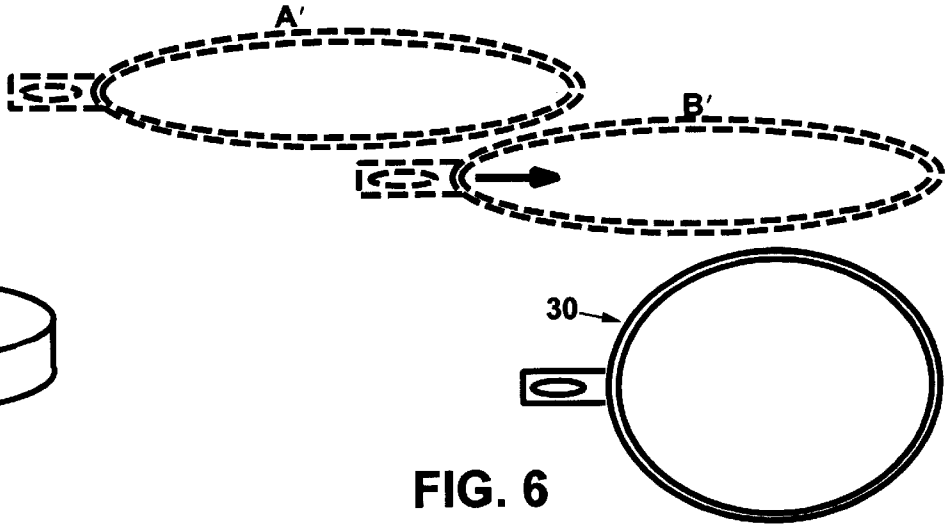
FIG. 6 is a top view of the inserting of the bedpan shown in FIG. 5 to show that the shape of the bedpan changes upon inserting.

The installing of the support ring is illustrated in FIG. 5, wherein the phantom outlines indicate the support ring at various times during the installing process. FIG. 6 shows stages of the lateral compression of the support ring 30 only. At A and A', the support ring 30 is laterally compressed to fit between the legs of the patient, and only the leading edge of the ring has entered the cavity. At B and B', the leading edge of the ring has touched the wall of the cavity so that further pressure to insert the ring causes it to expand to draw the opening of the flexible bedpan to an open position shown with full lines. After the ring 30 is expanded to substantially touch the entire wall of the of the cavity 42, when the fulcrum projection 36 is in contact with the bottom of the cavity and the trailing edge of the ring has entered the cavity, then the trailing edge may be pressed downward to tilt the ring 30 to a horizontal, fullly installed position, thereby to properly support the flexible bedpan 20.

For removing the flexible bedpan, a nurse or attendant grasps and pulls the tab 34 pulling the proximal portion of the rim of the support ring 30 upward and out of the cavity 42. Continued pulling of the tab 34 encourages the support ring 30 to compress it the transverse direction, thereby to permit easy withdrawal of the support ring 30, the attached flexible bedpan 20, and the excrement collected therein. After removing the assembly 10 from the cavity 42, the attendant can hold the assembly by the tab 34, thereby allowing the collected excrement to fall into a portion of the flexible bedpan that has volume-indicating indicia 26 that permits the observing of the quantity of excrement for recording in the patient's record. Samples of the excrement may be taken for testing, as desired, and the flexible bedpan 20 may be stripped from the support ring 30 and disposed of, allowing a new flexible bedpan to be fitted to the support ring 30 for reuse thereof as often as desired.

Figure 7:
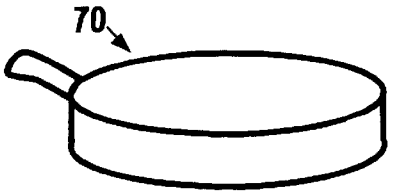
FIG. 7 is a perspective view of a support plug for use when the bedpan of this invention is not in immediate use.

A support plug 70 for filling the open space of the cavity 42 above the support ring 30 when the bedpan system is not in immediate use is shown in FIG. 7.

The above-disclosed invention has several particular features that are best practiced in concert, although each is useful individually, without departure from the scope of the invention. We have merely described preferred embodiments of the invention and it will be understood that the invention may be embodied otherwise than as herein illustrated and described. The scope of the invention should be determined by the appended claims and their legal equivalents, rather than only by the examples given.

I claim:

1. A bedpan system for use with an underlayment device for a supine human patient, said underlayment device rests upon a substantially horizontal supporting surface;

has a substantially horizontal top surface that is elevated above said supporting surface and upon which said patient rests; and has a substantially cylindrical cavity for receiving therein a bedpan, said cavity communicating at its upper end with said top surface and having a substantially circular open top in registry with the buttocks of said patient;

said bedpan system comprising, in combination:

a. a disposable bag-like bedpan fabricated from a flexible, water-impermeable web and having a wide opening for receiving into said bedpan human excrement from said patient and b. laterally-compressible hoop-like carrier attached to said disposable bedpan for supporting said wide opening around the perimeter of said carrier, and that, in use, assumes a state wherein said hoop is not laterally compressed but assumes the general shape of said cavity, holding open said wide opening of said bedpan in a substantially horizontal orientation within said cavity and below said top surface of said underlayment, wherein excrement from said human patient is readily received therein, wherein said hoop-like carrier is adapted by the presence of two fulcrum extensions located at substantially opposite sides of said hoop-like carrier to receive vertical support from said horizontal supporting surface.

2. A bedpan system for use with an underlayment device for a supine human patient, said underlayment device rests upon a substantially horizontal supporting surface;

has a substantially horizontal top surface that is elevated above said supporting surface and upon which said patient rests; and has a substantially cylindrical cavity for receiving therein a bedpan, said cavity communicating at its upper end with said top surface and having a substantially circular open top in registry with the buttocks of said patient;

said bedpan system comprising, in combination:

a. a disposable bag-like bedpan fabricated from a flexible, water-impermeable web and having a wide opening for receiving into said bedpan human excrement from said patient and b. a laterally-compressible hoop-like carrier attached to said disposable bedpan for supporting said wide opening around the perimeter of said carrier, and that, in use, assumes a state wherein said hoop is not laterally compressed but assumes the general shape of said cavity, holding open said wide opening of said bedpan in a substantially horizontal orientation within said cavity and below said top surface of said underlayment, wherein excrement from said human patient is readily received therein, wherein said hoop-like carrier is removably attached to said disposable bag-like bedpan, wherein said opening of bag-like bedpan comprises a cuff created by folding outward and downward the top edge of said opening so that said hoop-like carrier may be inserted into said cuff, thereby to support said opening in both a vertical and a lateral direction, and wherein a portion of said cuff is slit to allow passage therethrough of a tab firmly attached to said hoop-like carrier, said tab adapted to provide easy removal of said bedpan system from said cavity while said human patient is supine upon said underlayment.

3. A bedpan system for use with an underlayment device for a supine human patient, said underlayment device rests upon a substantially horizontal supporting surface;

has a substantially horizontal top surface that is elevated above said supporting surface; and has a substantially cylindrical cavity for receiving therein a bedpan, said cavity communicating at its upper end with said top surface and having a substantially circular open top in registry with the buttocks of said patient;

said bedpan system comprising, in combination:

a. a disposable bag-like bedpan fabricated from a flexible, water-impermeable web and having a wide opening for receiving into said bedpan human excrement from said patient and also having markings thereon to measure the volume of excrement collected;

b. a laterally-compressible hoop-like carrier removably attached to said disposable bedpan for supporting said wide opening around the perimeter of said carrier, and that, in use, assumes a state wherein said hoop is not laterally compressed but assumes the general shape of said cavity, holding open said wide opening of said bedpan in a substantially horizontal orientation within said cavity and below said top surface of said underlayment, wherein excrement from said human patient is readily received therein, said hoop-like carrier is adapted by the presence of two fulcrum extensions located at substantially opposite sides of said hoop-like carrier to receive vertical support from said horizontal supporting surface.

4. A method of using a bedpan system in combination with an underlayment for a supine human patient, said underlayment device:

rests upon a substantially horizontal supporting surface;

has a substantially horizontal top surface that is elevated above said supporting surface; and has a substantially cylindrical cavity for receiving therein a bedpan and having a surrounding wall, said cavity communicating at its upper end with said top surface and having a substantially circular open top in registry with the buttocks of said patient;

said system comprises:

a disposable bag-like bedpan fabricated from a flexible, water-impermeable web and having a wide opening for receiving into said bedpan human excrement from said patient; and a laterally-compressible hoop-like carrier removably attached to said disposable bedpan for supporting said wide opening around the perimeter of said carrier;

said method comprising the steps of:

while said patient lies in a supine position with buttocks in registry with said open top with legs narrowly spread and without the need for said patient to move;

to laterally collapse said hoop-like carrier, thereby forming a collapsed bedpan system having a leading end and a trailing end;

to slide said collapsed bedpan system between the narrowly-spread legs of said supine patient, the leading end of said bedpan system inserted into said cavity first and until said leading end contacts a portion of said wall;

to further move said bedpan system into the cavity whereupon the contact with said wall forces the expansion of said collapsed hoop-like carrier to eventually assume the shape of said cavity beneath said supine patient, thereby opening said wide opening of said bag-like bedpan and holding it in an open position.

5. The method of claim 4 wherein said method further comprises a further step of:

to pivot said bedpan system on fulcrum extensions of said hoop-like carrier when said extensions contact said horizontal supporting surface, thereby to change the orientation of said expanded hoop-like carrier from an inclined orientation that results from previous steps to a more horizontal orientation.

6. The method of claim 4 wherein, after said patient has completed use of said bedpan, it is removed from said cavity without said patient moving by using the following steps:

to reach between the narrowly-separated legs of said patient and grasp a tab firmly attached to said hoop-like carrier; and to pull on said tab, thereby pulling said bedpan system, compressing said carrier and pulling said compressed carrier and said attached bedpan from said cavity and from between said legs without requiring said patient to move and without spilling excrement from said bedpan.

* * * * *